US006155560A

United States Patent [19]

Cote et al.

[11] Patent Number: 6,155,560

[45] Date of Patent: Dec. 5, 2000

[54] METHOD AND APPARATUS FOR REORIENTING A PRINTABLE MEDIUM

[75] Inventors: Kevin Lauren Cote, Durham; David Clarke Pollock, Somersworth, both of N.H.

[73] Assignee: Heidelberger Druckmaschinen AG, Germany

[21] Appl. No.: 09/317,634

[22] Filed: May 25, 1999

[51] Int. Cl.[7] ..... B65H 5/00

[52] U.S. Cl. ..... 271/225; 271/184

[58] Field of Search ..... 271/225, 184

[56] References Cited

U.S. PATENT DOCUMENTS

| | | | |
|---|---|---|---|
| 5,188,355 | 2/1993 | Lowell et al. | 271/225 |
| 5,282,528 | 2/1994 | Hudson | 271/225 X |
| 5,318,285 | 6/1994 | Edwards et al. | 271/225 |
| 5,855,153 | 1/1999 | Cote et al. . | |

OTHER PUBLICATIONS

"Baldwin Stobb PowerTurn 260™", Baldwin Stobb of San Bernardino, CA , Aug. 1997, 2 pgs.

*Primary Examiner*—David H. Bollinger

*Attorney, Agent, or Firm*—Burns Doane Swecker & Mathis L.L.P.

[57] ABSTRACT

The present invention is directed to a method and apparatus for reorienting printable material, such as the signatures of a web fed rotary printing press, in a manner whereby a new velocity vector can be positively imparted to a signature instantaneously. Exemplary embodiments used selected portions of a drive mechanism to actively redirect the signatures with a new velocity vector. Because the new velocity vector is actively imparted to the signatures, exemplary embodiments provide a highly reliable reorientation of the signatures, without causing damage to the signatures, and without risking potential jamming of the printing press. Exemplary embodiments of the present invention not only preserve the quality of a shingled stream by providing an ability to retain the original lateral alignment and pitch of the incoming shingled stream, but in addition, exemplary embodiments can correct the pitch between signatures of an incoming shingled stream.

12 Claims, 4 Drawing Sheets

METHOD AND APPARATUS FOR REORIENTING A PRINTABLE MEDIUM

BACKGROUND OF THE INVENTION

1. Field of the Invention

The present invention generally relates to printing, and more particularly, to a method and apparatus for reorienting a printable material, such as printed signatures, in a rotary offset printing press.

2. State of the Art

Known printing presses, such as rotary offset printing presses, often include some mechanism for reorienting a stream of signatures which have been severed from a web of printable material. A conventional reorienting mechanism is configured using one or more walls for initiating what is known in the art as a "bump turn".

To effect a conventional bump turn, a signature is initially transported with a first velocity vector in a first direction. The signature is transported into a wall which ideally decelerates the original velocity vector of the signature to zero, such that a new transport belt can accelerate the signature with a new velocity vector (that is, a new direction) instantaneously. However, in actuality, the reduction of the original velocity vector to zero and the simultaneous establishment of a new velocity vector in the new direction does not occur instantaneously for a number of reasons. For example, frictional forces acting on the signatures prevent an instantaneous transition from the original velocity vector to the new velocity vector. As such, conventional bump turns suffer significant disadvantages.

Among the disadvantages of conventional bump turns are their unreliability in initiating a new velocity vector. In addition, bump turns can result in damage to the signatures and jamming of the press. Moreover, where the stream of signatures are to be maintained in a consistent, shingled stream, conventional bump turns are unable to preserve accurate alignment of lateral edges of the stream, and are unable to maintain an accurate and reliable pitch (i.e., spacing) between adjacent signatures in the stream.

Attempts to address the deficiencies of conventional bump turns include using an in-running nip in conjunction with a partial bump turn. For example, a document entitled "Baldwin Stobb PowerTurn 260™" describes a signature stream reorientation device available from Baldwin Stobb of San Bernardino, Calif. wherein a conventional wall interface is used in conjunction with a rotating drum oriented at 45° to the incoming signatures. The signatures are wrapped around the drum and then directed into the wall of the partial bump turn. Because a partial bump turn is still included in the device, the potential for damage to the signatures or jamming of the press still exists. In addition, the use of a partial bump turn can affect the quality of the shingled stream of signatures.

Accordingly, it would be desirable to provide a method and apparatus for reorienting printable material in a printing apparatus such that the reliability of the reorientation can be assured. In so doing, it would be desirable to reduce or eliminate the potential for causing damage to the signatures or jamming of the press, while at the same time, maintaining or improving the quality (e.g., pitch and alignment) of the output stream of signatures.

SUMMARY OF THE INVENTION

The present invention is directed to a method and apparatus for reorienting printable material, such as the signatures of a web fed rotary printing press, in a manner whereby a new velocity vector (that is, a vector defined by the speed and direction of the signature) can be positively imparted to a signature instantaneously. Exemplary embodiments used selected portions of a drive mechanism to actively redirect the signatures with a new velocity vector. Because the new velocity vector is actively imparted to the signatures, exemplary embodiments provide a highly reliable reorientation of the signatures, without causing damage to the signatures, and without risking potential jamming of the printing press. Exemplary embodiments of the present invention not only preserve the quality of a shingled stream by providing an ability to retain the original lateral alignment and pitch of the incoming shingled stream, but in addition, exemplary embodiments can correct the pitch between signatures of an incoming shingled stream.

Generally speaking, exemplary embodiments of the present invention relate to a method and apparatus for reorienting a printable material in a web fed rotary printing press, comprising: at least one stage for feeding a printable material with a first velocity vector; and at least one additional stage for actively imparting a new velocity vector to said printable material, said additional stage including at least one drive device having at least one predetermined area for contacting said printable material.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

Figure 1:
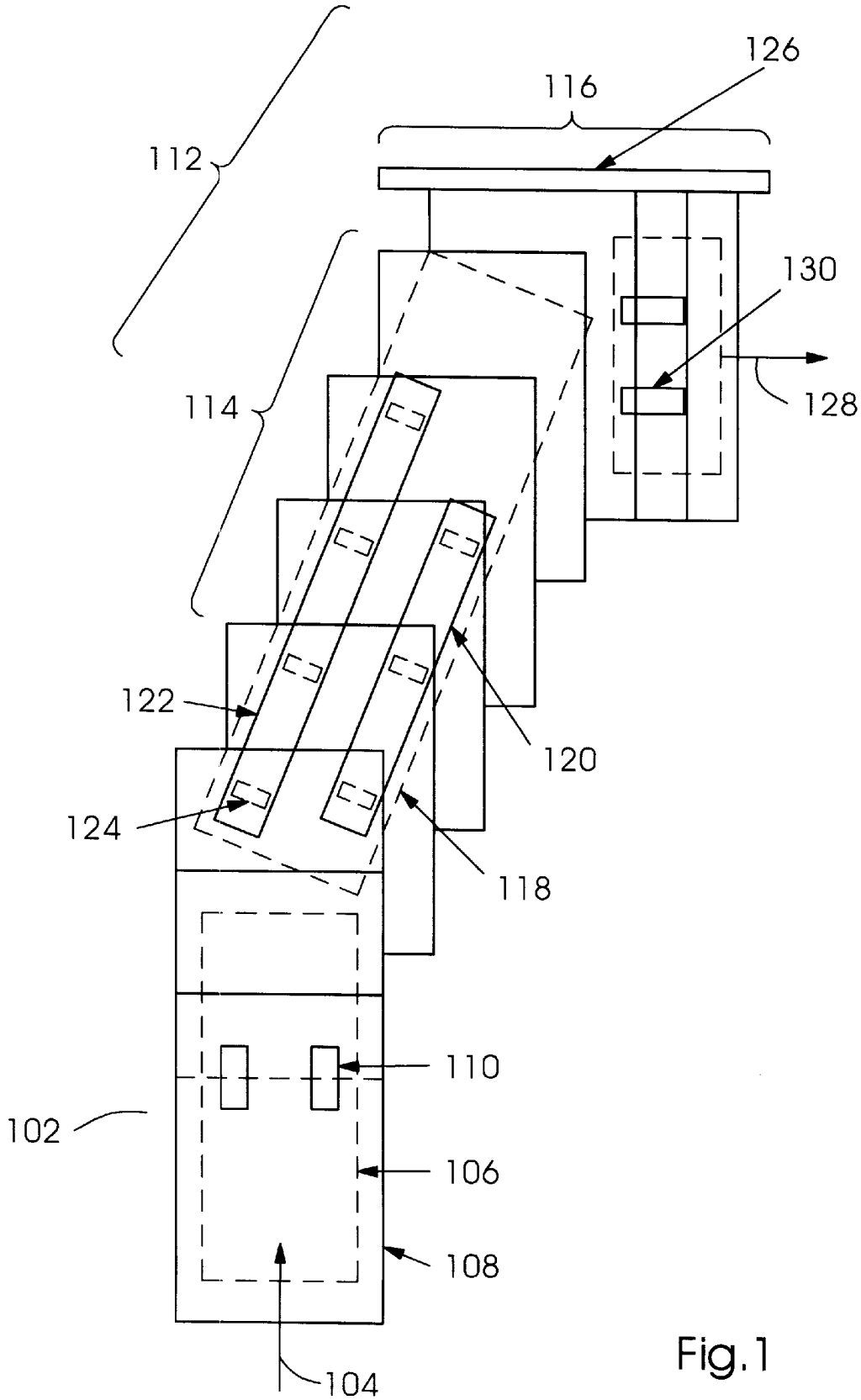
FIG. 1 shows an exemplary embodiment of an apparatus for reorienting a signature stream 90° in accordance with the present invention.

FIG. 1 shows an exemplary apparatus 100 for reorienting a printable material, such as a stream of signatures in a web fed rotary printing press. At least one stage, represented as a first feed stage 102, is provided for feeding signatures with a first velocity vector in a direction designated by arrow 104. The first feed stage 102 includes a lower infeed transport belt 106 for supporting a shingled stream of incoming signatures 108 (that is, a stream of signatures wherein adjacent signatures partially overlap). The signatures are secured on the transport belt 106 by nip belts or rollers 110 or any other similar device. Of course, any known signature transport configuration can be used, provided it can be configured to operate with a reorientation stage 112 in accordance with the present invention.

That is, signatures are transported from the feed stage 102 into at least one additional stage, represented in FIG. 1 as the reorientation stage 112, for actively imparting a new velocity vector to the signature stream. The reorientation stage 112 includes at least one drive device having at least one predetermined area for contacting the signatures. In the exemplary FIG. 1 embodiment, the reorientation stage 112 includes a first part 114 represented as an angled transport stage and a second part 116 represented as an exit stage.

The first part 114 is configured in FIG. 1 to include a lower transport belt 118 which supports the signatures received from the feed stage 102. In addition, the first part 114 of the reorientation stage 112 includes at least one upper belt 120 having at least one predetermined area for contacting a signature. In the FIG. 1 embodiment, the first part 114 includes two upper belts, represented by the upper belt 120 and an additional upper belt 122, also configured with at least one predetermined area for contacting signatures. The lower transport belt 118, and the upper belts 120 and 122 are oriented at a predetermined angle with respect to the feed stage 102 to reorient the signature stream. Two belts are illustrated because they provide an enhanced torque for imparting the new velocity vector to the signatures without slippage.

Those skilled in the art will appreciate that exemplary embodiments of the present invention, although configured with two upper belts 120 and 122, can be configured using a single upper belt of any desired width or length. In addition, the first part 114 of the second stage, although angled in FIG. 1 at approximately 45° with respect to the feed direction of the feed stage 102 (represented by arrow 104), can be placed at any angle, although typically the angle will be 90° or less.

The lengths of the upper belts 120 and 122 in the FIG. 1 embodiment are shown as being different to accommodate the signature stream output by the feed stage 102. That is, the lengths are selected such that predetermined areas on each of the two upper belts contact a particular signature output from the feed stage 102 at the same time. Of course, if a single belt is used, relative lengths are not an issue.

The upper belts 120 and 122 can be driven in any conventional manner. For example, the upper and lower belts can be configured to be driven in synchronism with the press, and for this purpose, can be configured as a conventional synchronous drive belt of a press, modified to include the predetermined areas to be described herein. For example, the drive belts can be configured as toothed belts, driven by a press gear which is operated in synchronism with the press. Of course, exemplary embodiments are not limited to such a drive configuration. For example, rather than using belts with teeth driven by one or more synchronized press gears, the belts can be operated by a shaftless motor which, through the use of a feedback loop, is operated in synchronism with the press. It is only important that the predetermined areas of the upper belts be maintained in synchronism with one another and with the feed stage so that they contact signatures output from the feed stage 102 at the desired time. Those skilled in the art will also appreciate that although a common synchronous drive was discussed with respect to the upper belts 120 and 122, each of these belts can be driven independently provided they are driven in synchronism with one another and the feed stage 102. Those skilled in the art will also appreciate that to ensure an accurate and reliable reorientation, the synchronism of the various stages described herein can be implemented such that as the leading edge of the signature is being nipped to the lower belt of the second part 116, the signature is simultaneously being released by overhead nipping elements (i.e., the lugs) included in the upper belts 120 and 122 of the angled transport section.

In accordance with exemplary embodiments, the upper belts can be configured in a manner similar to that described in commonly assigned U.S. Pat. No. 5,855,153, the contents of which are hereby incorporated by reference in their entirety. The predetermined areas which contact signatures output from the feed stage 102 are represented in the FIG. 1 embodiment as revised portions referred to as cleats, or lugs, 124. These lugs protrude from the belts in a direction towards the signatures, and constitute the only portions of the upper belts which contact the signatures. The lugs can be formed integrally with their respective upper belt, or can be formed as separate components which are then attached (e.g., glued) to the belts.

Those skilled in the art will appreciate that any materials can be used for the belts and lugs including, but not limited to, urethane, rubber or any other suitable material which can provide an adequate coefficient of friction. That is, any material which can establish an adequate coefficient of friction sufficient to reorient signatures output from the feed stage 102 can be used, and should be selected based on a particular application (e.g., speed of operation, materials selected for the printable medium and so forth).

The number of lugs included on the respective belts can be adjusted accordingly, depending on the particular application as a function of, for example, the number of signatures to be reoriented at any given time as well as space requirements. The number of lugs per belt associated with each signature to be reoriented can also be adjusted as desired. In the FIG. 1 embodiment, each of the upper belts 120 and 122 includes one lug per signature. However, each lug can be configured as a plurality of smaller lugs, or as any protrusion(s) for establishing a desired coefficient of friction between the lug and the signature.

Signatures output from the first part 114 of the reorientation stage 112 are supplied in the FIG. 1 embodiment to a second part 116 of the reorientation stage which includes an optional guide edge 126. The guide edge operates in conventional fashion to again redirect signatures with a new velocity vector. In the exemplary FIG. 1 embodiment, the new direction is represented by an arrow 128, and results in signatures being diverted by a predetermined angle (for example 90° in FIG. 1) from their original direction of transport (as represented by arrow 104).

To establish the new velocity vector along the direction of arrow 128, the second part 116 includes, in addition to the guide edge 128, a drive device. For example, the drive device can be one or more rollers and or associated belts, as represented by drive device 130. The second part 116 of the reorientation stage 112 can be provided to ensure alignment of lateral edges of signatures in the reoriented shingled stream. The guide edge can be a fixed guide, or can be configured to move with the signatures, such as a tape mounted on pulleys with vertically oriented axes. Having described the exemplary embodiment of FIG. 1, a more detailed description of the upper belts 120 and 122 will now be discussed with respect to FIG. 2.

Figure 2A:
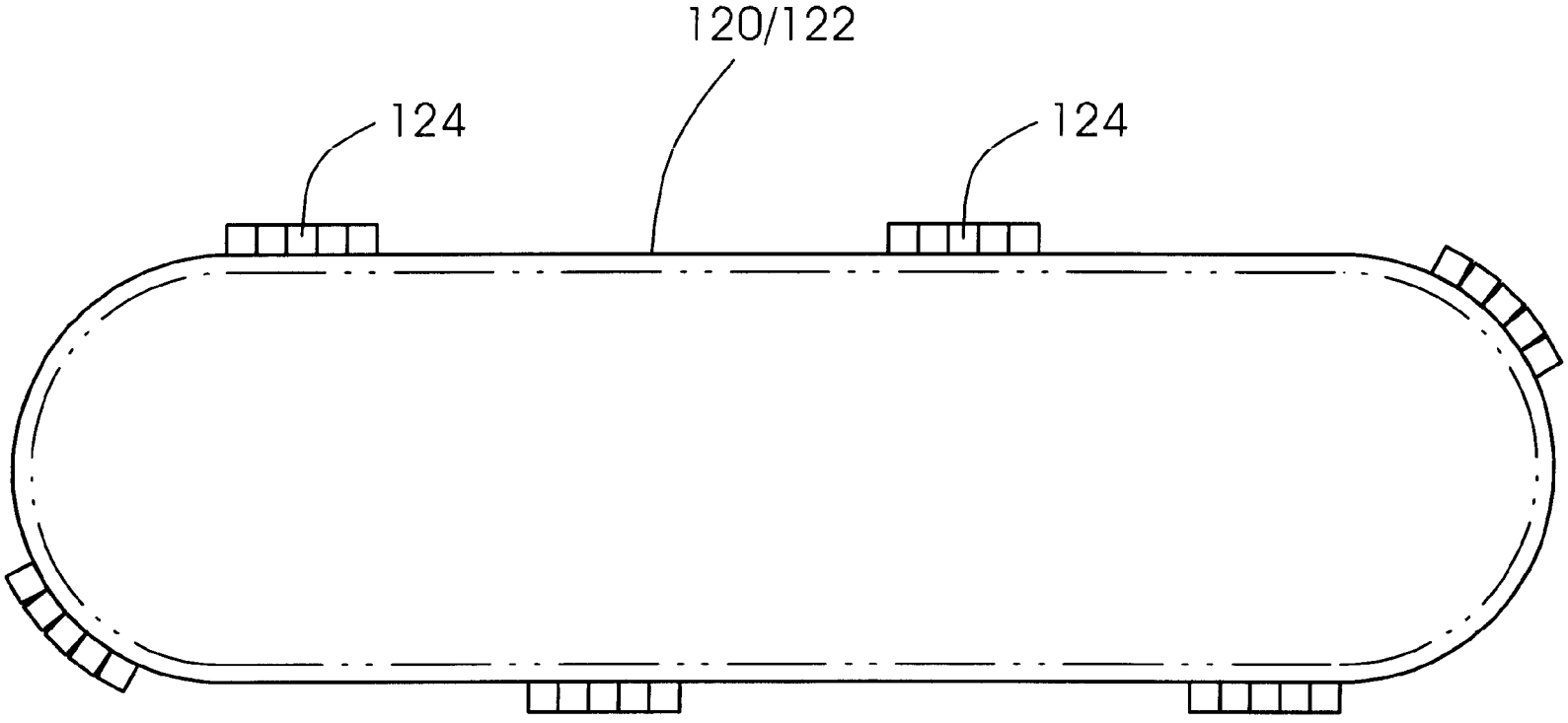
FIG. 2A shows an exemplary embodiment of a drive device implemented as a belt with raised portions.

FIG. 2A illustrates an exemplary embodiment of the drive device for reorienting signatures in the first part 114 of the second stage 112. Here, each drive device is configured as a belt (that is, the upper belts 120 and 122 of FIG. 1), having one or more predetermined areas represented as the raised portions 124. The belt shown in FIG. 2A can, for example, be configured in a manner similar to the belts described in U.S. Pat. No. 5,855,153.

Figure 2B:
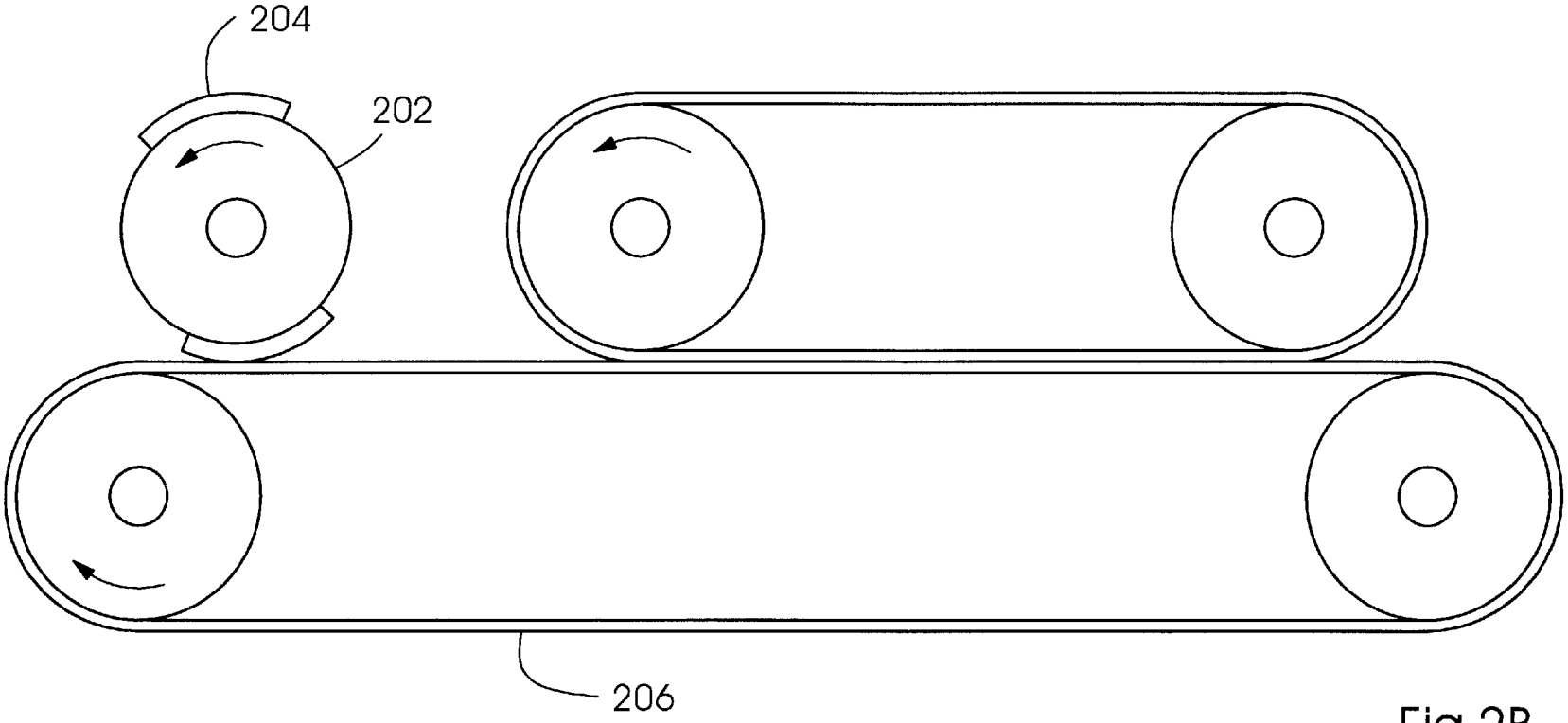
FIG. 2B shows an exemplary embodiment of a drive device configured as a roller with raised portions.

FIG. 2B shows an alternate exemplary embodiment of a drive device for imparting a new velocity vector to signatures output from the feed stage 102. Here, the device is configured as a roller 202 having at least one predetermined area 204 for contacting the signature. Two such raised portions are shown in the FIG. 2B embodiment. The roller 202 can be used to replace the portion of the upper belt 120 which overlaps a signature output from the feed stage 102 in FIG. 1. A similar roller can be used to replace the portion of the upper belt 122 which overlaps a signature as it is output from the feed stage 102. The raised portions 204 thereby function in a manner similar to that of the lugs 124 of FIG. 1 which are used to reorient a signature as it departs the feed stage 102. The predetermined areas 204 press the signature against the lower belt 206 which functions in a manner similar to that described with respect to the lower transport belt 118 of FIG. 1. After the roller imparts the new velocity vector to the signatures output from the feed stage, it can be processed downstream in any desired fashion. For example, the reoriented signatures can be transported over any distance, using conventional drive belts 206 and 208. Of course, each of the drive belts 206 and 208 can be configured using any number of parallel drive belts to transport the signatures.

Figure 3:
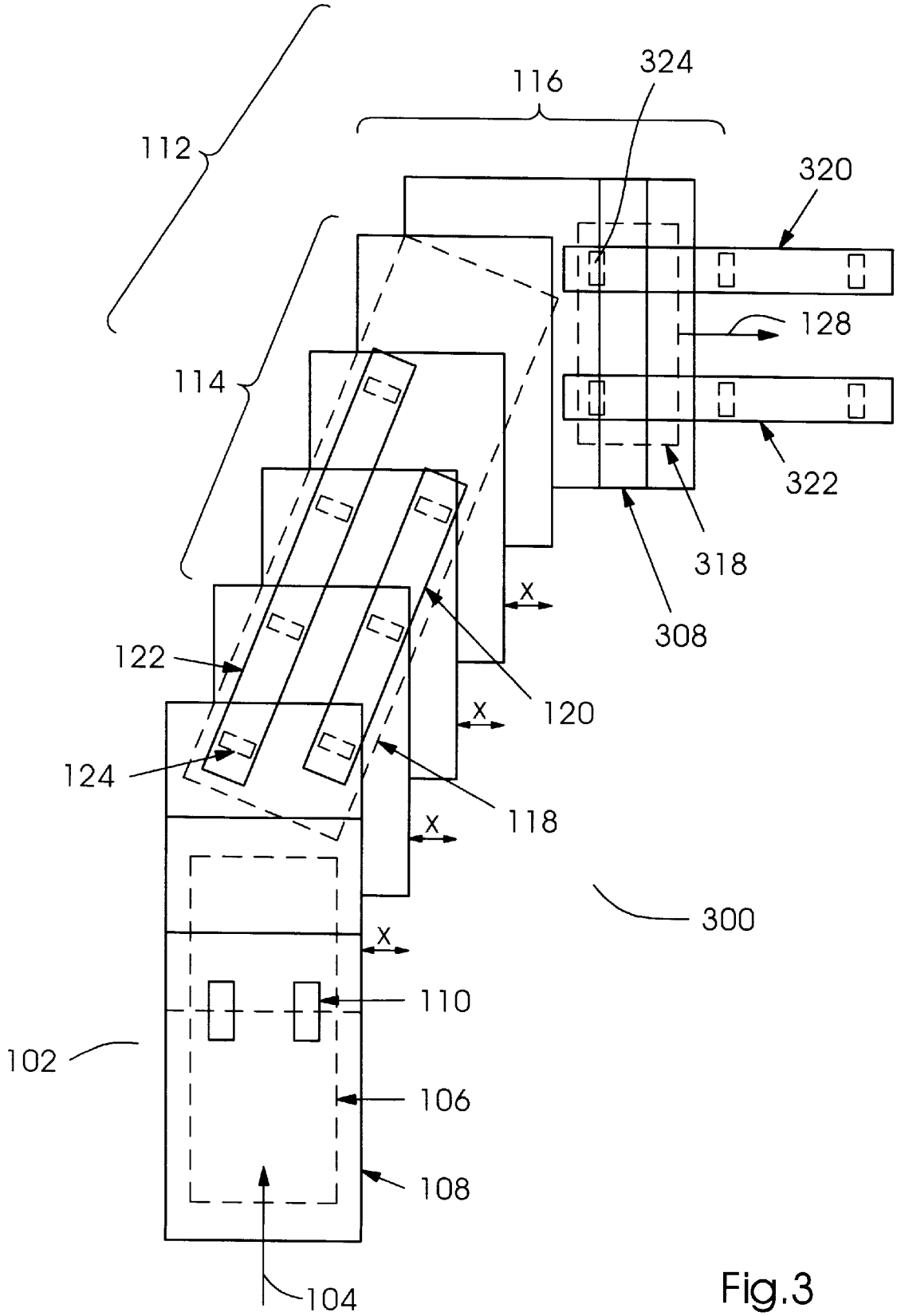
FIG. 3 shows an alternate exemplary embodiment of the present invention for reorienting a stream of signatures 90°.

FIG. 3 shows an alternate exemplary embodiment of the present invention wherein elements similar to those in FIG. 1 have been similarly labeled. In the FIG. 3 embodiment of a reorientation apparatus 300, the second part 116 of the reorientation stage 112 has been reconfigured to eliminate use of the optional guide edge 126 (FIG. 1) and instead, includes the use of additional upper belts 320 and 322. Each of the upper belts 320 and 322 is configured with lugs 324 similar to those described with respect to the drive belts 120 and 122. As with the drive belts 120 and 122, the upper drive belts 320 and 322 cooperate with a lower transport belt 318 to transport signatures 308 from the second part 116 to an output of the reorientation apparatus 300. Thus, the exemplary FIG. 3 embodiment illustrates that any number of substages in the reorientation stage can be used to reorient the signatures to any desired angle relative to the feed direction of arrow 104.

Exemplary embodiments of the present invention, not only enable the alignment and pitch of an incoming shingled stream to be maintained at an output following reorientation, but in addition, can actually correct pitch. That is, where the signatures supplied to the feed stage 102 have variable pitch (i.e., varying distances between adjacent signatures), the lugs on the upper belts 120 and 122 will simply contact the signatures at different relative locations. Because the upper belts 120 and 122 are synchronized to each other and to the press, the lateral offset labeled "x" in FIG. 3 between successive signatures as they are being reoriented will, however, be fixed. As such, when the signatures are supplied to the second part 116 of the reorientation stage 112, the pitch between signatures will be fixed. Thus, even though variations in pitch may have existed in the incoming shingled stream, the output shingled stream will have a fixed pitch.

It should be noted that correcting the pitch between adjacent signatures of FIG. 3 will result in a lateral offset of the signatures in the output shingled stream. However, this lateral offset can be easily corrected using a downstream device to simply nudge the signatures into alignment. For example, a paddle device or any other guide edge, well known in the art, can be used to correct lateral alignment. Thus, exemplary embodiments not only provide a reliable and efficient way to reorient signatures, but in addition, can correct pitch in the process.

Those skilled in the art will appreciate that although exemplary embodiments described herein have been directed to reorienting a shingled stream and/or correcting pitch, it would also be possible to correct pitch without reorienting the shingled stream. For example, a mirror-image of the reorientation stage 112 shown in FIG. 3 can be provided at the output of the shingled stream in FIG. 3 to redirect the shingled stream back to the original direction of transport 104. The net effect would be to maintain the output stream in the direction of origin, but to correct pitch in the process.

Those skilled in the art will appreciate that exemplary embodiments of the present invention can be used in conjunction with folded or with unfolded signatures. In addition, exemplary embodiments can be used in connection with signatures of any size, or with any printable material, and the present invention is not limited to exemplary embodiments described herein.

In addition, the exemplary embodiments described with respect to FIG. 1 include a reorientation stage having first and second parts, wherein a reorientation angle of the second part is the complement of the angle established between the first part and the feed stage. However, those skilled in the art will appreciate that any angles can be used in accordance with the present invention, and that reorientation is not limited to a single flat plane, but can be a reorientation implemented while signatures travel in multiple planes. Exemplary embodiments of the present invention can be used in conjunction with folded or unfolded signatures as well. Where folded signatures are to be reoriented such as where, for example, a lateral folded edge of an incoming signature is to be translated to a leading edge of the signature, exemplary embodiments of the present invention can be used without regard to the location of the folded edge in the incoming stream. That is, in accordance with exemplary embodiments, the folded edge can be the leading edge of incoming signatures which are to be reoriented such that the leading edge becomes an unfolded edge or alternately, the folded edge can be a lateral edge of an incoming signature which is to be reoriented such that the folded edge becomes the leading edge.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. Apparatus for reorienting a printable material in a web fed rotary printing press, comprising:

at least one stage of feeding a printable material with a first velocity vector; and at least one additional stage for actively imparting a new velocity vector to said printable material, said additional stage including at least one drive device having at least one predetermined area for contacting said printable material; and wherein said at least one stage includes at least one transport belt for delivering a shingled stream of signatures to said additional stage.

2. Apparatus according to claim 1, wherein said at least one drive device includes at least one belt for transporting said printable material in synchronism with said one stage.

3. Apparatus according to claim 1, wherein said at least one drive device includes at least one belt for transporting said printable material in synchronism with said one stage.

4. Apparatus according to claim 3, wherein said additional stage includes:

at least two upper belts, each having at least one raised portion in said at least one predetermined area for contacting printable material output from said one stage.

5. Apparatus according to claim 4, wherein said at least one additional stage comprises:

an angled transport stage which includes said at least one drive device for transporting said printable material at an angle relative to said first velocity vector; and an exit stage for transporting said printable material at a second angle relative to a transport direction of said angled transport stage.

6. Apparatus according to claim 5, wherein said second angle is the complement of said first angle.

7. Apparatus according to claim 1, wherein said at least one drive device is driven in synchronism with said one stage to correct variations in pitch between signatures fed from said at least one stage.

8. Apparatus according to claim 1, wherein said at least one drive device includes:

a roller configured with raised portions in said predetermined area for contacting said printable material.

9. Method for reorienting a printable material in a web fed rotary printing press, comprising the steps of:

feeding a printable material with a first velocity vector; and actively imparting a new velocity vector to said printable material by contacting said printable material with a predetermined area of at least one drive device; and wherein said steps of feeding and actively imparting are performed in synchronism with operation of said printing press.

10. Method according to claim 9, wherein said step of actively imparting includes:

correcting pitch between signatures fed as said printable material.

11. Method according to claim 9, wherein said step of actively imparting includes steps of:

transporting said printable material at a predetermined angle with respect to said first velocity vector; and outputting said printable material in a direction of said new velocity vector, said new velocity vector being angled with respect to said transport direction.

12. Method according to claim 11, wherein said direction of said new velocity vector possesses an angle which is the complement of the angle between said transport direction and said first velocity vector.

* * * * *